US008899570B2

(12) United States Patent
Hwang et al.

(10) Patent No.: US 8,899,570 B2
(45) Date of Patent: Dec. 2, 2014

(54) MOVING RAIL ASSEMBLY AND APPARATUS FOR RECEIVING AND DISPENSING BILL

(71) Applicant: Nautilus Hyosung Inc., Seoul (KR)

(72) Inventors: Jin Young Hwang, Seoul (KR); Jong Seong Park, Anyang-si (KR); Chang-Ho Park, Gunpo-si (KR); Su Hyoun Yun, Seongnam-si (KR); Young Chul Lee, Anyang-si (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 14/139,149

(22) Filed: Dec. 23, 2013

(65) Prior Publication Data

US 2014/0183817 A1 Jul. 3, 2014

(30) Foreign Application Priority Data

Dec. 27, 2012 (KR) ..... 10-2012-0154084
Dec. 27, 2012 (KR) ..... 10-2012-0154087

(51) Int. Cl.

| | |
|---|---|
| ***B65H 5/22*** | (2006.01) |
| ***G07F 19/00*** | (2006.01) |
| ***B65H 31/30*** | (2006.01) |
| ***B65H 83/02*** | (2006.01) |
| ***G07D 11/00*** | (2006.01) |

(52) U.S. Cl.

CPC ..... *G07F 19/203* (2013.01); *B65H 31/3063* (2013.01); *B65H 83/02* (2013.01); *G07D 11/0018* (2013.01); *B65H 2301/42142* (2013.01); *B65H 2301/42254* (2013.01); *B65H 2408/13* (2013.01); *B65H 2701/1912* (2013.01)

USPC ..... 271/3.01

(58) Field of Classification Search

USPC ..... 271/3.01, 3.05, 3.08, 3.12, 3.13; 221/191, 195; 902/14

See application file for complete search history.

(56) References Cited

U.S. PATENT DOCUMENTS

| | | | | |
|---|---|---|---|---|
| 4,744,468 | A * | 5/1988 | Goi et al. | 209/534 |
| 4,889,240 | A * | 12/1989 | Sato et al. | 209/534 |
| 7,086,585 | B2 * | 8/2006 | Lee | 235/379 |
| 7,431,205 | B2 * | 10/2008 | Nomiyama et al. | 235/379 |
| 8,777,218 | B2 * | 7/2014 | Nemoto | 271/216 |
| 2004/0108328 | A1 * | 6/2004 | Youn | 221/195 |

FOREIGN PATENT DOCUMENTS

| | | |
|---|---|---|
| KR | 10-2011-0056945 | 5/2011 |
| KR | 10-2011-0104645 | 9/2011 |

* cited by examiner

*Primary Examiner* — David H Bollinger
(74) *Attorney, Agent, or Firm* — Fenwick & West LLP

(57) ABSTRACT

Disclosed are a moving rail assembly and a bill receiving and dispensing apparatus which are configured such that an angle at which a carriage unit moves along a rail can be adjusted to various angles. The moving rail assembly includes a moving body, a main rail and a sub-rail. The moving body includes a main rotating roller and a sub-rotating roller disposed at a different widthwise position from the main rotating roller. The main rail has a first path for guiding the main rotating roller, and a second path for guiding the sub-rotating roller. The first path and the second path extend parallel to each other. The sub-rail branches off from the second path and extends in a different direction from the main rail. The sub-rail guides the sub-rotating roller.

10 Claims, 11 Drawing Sheets

MOVING RAIL ASSEMBLY AND APPARATUS FOR RECEIVING AND DISPENSING BILL

CROSS-REFERENCE TO RELATED APPLICATIONS

This application claims the benefit of Korean Patent Application No. 10-2012-0154087, filed on Dec. 27, 2012 and Korean Patent Application No. 10-2012-0154084, filed on Dec. 27, 2012, which are incorporated by reference herein in their entirety.

FIELD OF THE INVENTION

The present invention relates to a moving rail assembly and an apparatus for receiving and dispensing bills.

BACKGROUND OF THE INVENTION

Generally, ATMs (automated teller machines) can rapidly, conveniently and automatically provide most financial services, except counseling work, regardless of time.

ATMs are classified into a pocket type ATM and a present type ATM according to a method of receiving and dispensing bills.

The pocket type ATM has a pocket type bill receiving space, so that a user puts his/her hand into the space inside a shutter of a bill receiving and dispensing apparatus, that is, into the bill receiving space, to deposit or withdraw bills.

The present type ATM is configured such that, when a portion of a bill is inserted into a bill receiving or dispensing port of a bill receiving and dispensing apparatus, the bill is automatically received into the apparatus, and when a bill is dispensed from the apparatus, the bill is located at a position at which a portion of the bill comes out of the apparatus.

In some cultural areas, people are reluctant to put their hands into machines such as pocket type ATMs. In these areas, present type ATMs that enable for users to deposit or withdraw bills without putting their hands into machines are preferred.

The pocket type ATMs and the present type ATMs have very different structures in terms of not only the positions of the bill receiving and dispensing portion and the shutter but also the entire design pertaining to the bill receiving and dispensing apparatus pertaining to a structure for separating bills from each other sheet-by-sheet or piling bills, arrangement of a transfer path, etc.

Manufacturers for ATMs must produce the two types of ATMs to meet various requirements of consumers. However, because the two types of ATMs are very different from each other, the number of design processes and the amount of equipment required for manufacturing ATMs are increased. Therefore, manpower is wasted and cost to the manufacturer is increased.

SUMMARY OF THE INVENTION

It is, therefore, an object of the present invention to provide a moving rail assembly and an apparatus for receiving and dispensing bills which are configured such that a direction in which bills are received or dispensed can be adjusted at various angles to enable a user to conveniently deposit or withdraw bills.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, exemplary embodiments of the present invention will be described with reference to the accompanying drawings, in which a repeated description will be omitted or compressed if possible, for clarity.

Figure 1:
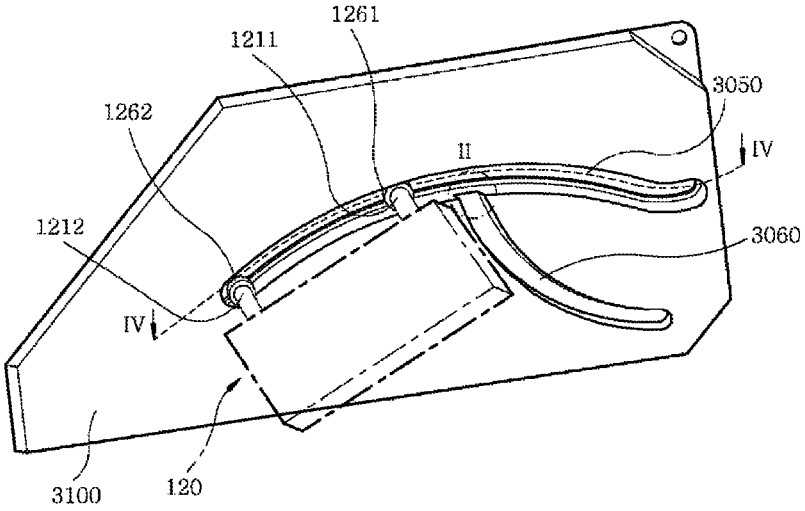
FIG. 1 is a view showing the construction of a moving rail assembly in accordance with the present invention.
Figure 2:
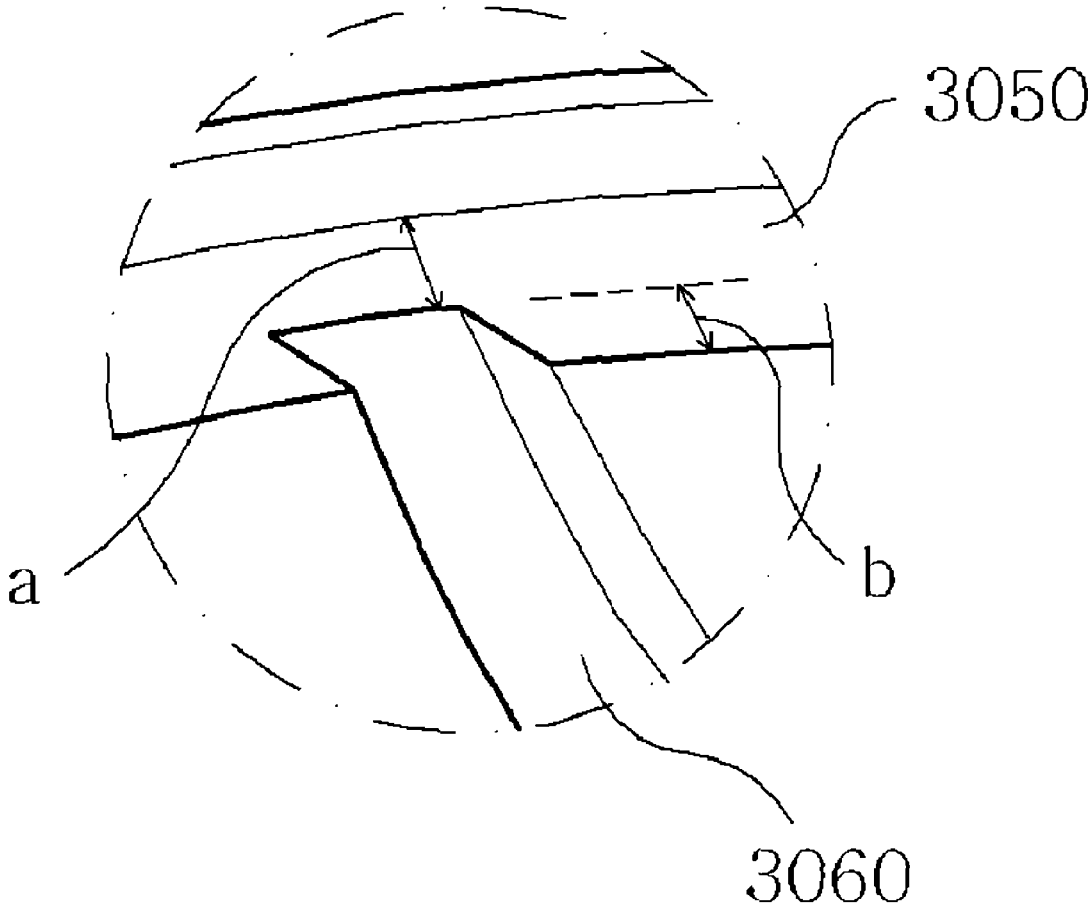
FIG. 2 is an enlarged view showing portion " " of FIG. 1.
Figure 3:
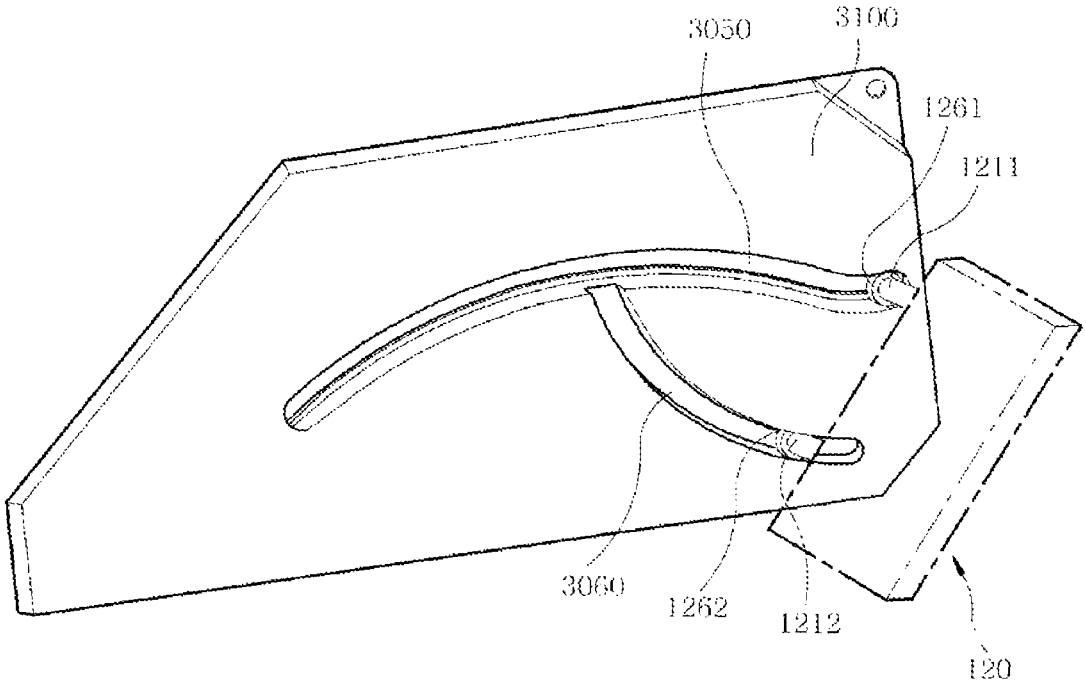
FIG. 3 is a view showing conditions of the moving rail assembly after the operation thereof is completed in accordance with the present invention.
Figure 4:
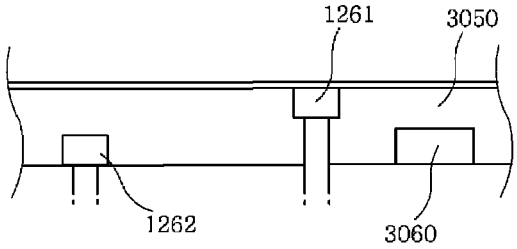
FIG. 4 is a plan view taken along line "-" of FIG. 1.

FIG. 1 is a view showing the construction of a moving rail assembly in accordance with the present invention. FIG. 2 is an enlarged view showing portion " " of FIG. 1. FIG. 3 is a view showing conditions of the moving rail assembly after the operation thereof is completed, in accordance with the present invention. FIG. 4 is a plan view taken along line "-" of FIG. 1.

As shown in FIGS. 1 through 4, the moving rail assembly in accordance with the present invention includes a main rail 3050, a sub-rail 3060 and a moving body 120.

In detail, the main rail 3050 includes a plurality of paths a and b which have different widthwise positions. At least one of the paths a and b branches off from the main rail 3050 and is connected to the sub-rail 3060.

A main rotating roller 1261 and a sub-rotating roller 1262 respectively move along the paths a and b. For example, the main rotating roller 1261 can continuously move along the main rail 3050. The sub-rotating roller 1262 can move along a portion of the main rail 3050 and enters the sub-rail 3060, or the sub-rotating roller 1262 that has moved along the sub-rail 3060 can enter the main rail 3050 and move along it.

The main rail 3050 is embodied by an elongated depression or slot which is formed in a guide plate 3100. In this embodiment, although the main rail 3050 is illustrated as providing a first path a which is disposed in an outer side of the guide plate 3100 and along which the main rotating roller 1261 moves, and a second path b which is disposed in an inner side of the guide plate 3100 and along which the sub-rotating roller 1262 moves, the main rail 3050 may provide three or more paths having different widthwise positions.

The sub-rail 3060 branches from the main rail 3050 and is connected to one of the paths a and b of the main rail 3050. The sub-rail 3060 extends such that there is a height different between it and the paths of the main rail 3050. A path defined by the sub-rail 3060 is connected to one of the paths a and b of the main rail 3050 and is continuously extended downwards therefrom with a predetermined curvature radius.

The sub-rail 3060 provides a curvature path opposing to that of the main rail 3050. Thereby, when the sub-rotating roller 1262 moves, the moving body 120 can rotate around the main rotating roller 1261 by a predetermined angle depending on a distance that the sub-rotating roller 1262 moves.

The moving body 120 moves along the main rail 3050 and the sub-rail 3060. When a rear part of the moving body 120 moves while a front part of the moving body 120 is stationary at a specific position in the main rail 3050, the moving body 120 rotates in a place at a predetermined position. Thereby, an inclination angle of the moving body 120 can be precisely adjusted.

For this, the main rotating roller 1261 is connected to the front part of the moving body 120 by a main rotating shaft 1211. The sub-rotating roller 1262 is connected to the rear part of the moving body 120 by a sub-rotating shaft 1212. The main rotating roller 1261 moves along the main rail 3050, and the sub-rotating roller 1262 moves along the main rail 3050 and the sub-rail 3060.

Particularly, to make the sub-rotating roller 1262 that has moved along the main rail 3050 enter the sub-rail 3060, the sub-rotating shaft 1212 of the sub-rotating roller 1262 and the main rotating shaft 1211 of the main rotating roller 1261 have different lengths so that the sub-rotating roller 1262 and the main rotating roller 1261 are located at different widthwise positions.

For example, if the sub-rotating shaft 1212 is shorter than the main rotating shaft 1211, the sub-rotating roller 1262 is located at a more inner side of the guide plate 3100 than is the main rotating roller 1261. The sub-rotating roller 1262 that moves along the main rail 3050 can branch off from the main rail 3050 into the sub-rail 3060.

Figure 5:
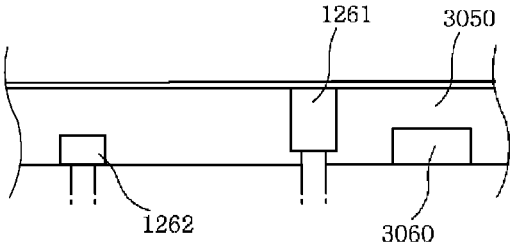
FIG. 5 is a plan view taken along line "-" of FIG. 1 in accordance with a modification example.

FIG. 5 is a plan view taken along line "-" of FIG. 1 in accordance with a modification example.

As shown in FIG. 5, in this modification example, the main rotating roller 1261 and the sub-rotating roller 1262 have different widths. In this case, the main rotating roller 1261 can move along the main rail 3050, and the sub-rotating roller 1262 can move along the main rail 3050 and branch off from the main rail 3050 into the sub-rail 3060.

For instance, if the width of the main rotating roller 1261 is greater than that of the sub-rotating roller 1262, the main rotating roller 1261 moves along both the first path a and the second path b of the main rail 3050 without branching off from the main rail 3050 into the sub-rail 3060. When the sub-rotating roller 1262 that moves along the main rail 3050 meets the sub-rail 3060 a width of which corresponds to that of the sub-rotating roller 1262, the sub-rotating roller 1262 branches off from the main rail 3050 and enters the sub-rail 3060.

Hereinafter, an embodiment of a bill receiving and dispensing apparatus using the moving rail assembly in accordance with the present invention will be described in detail.

Figure 6:
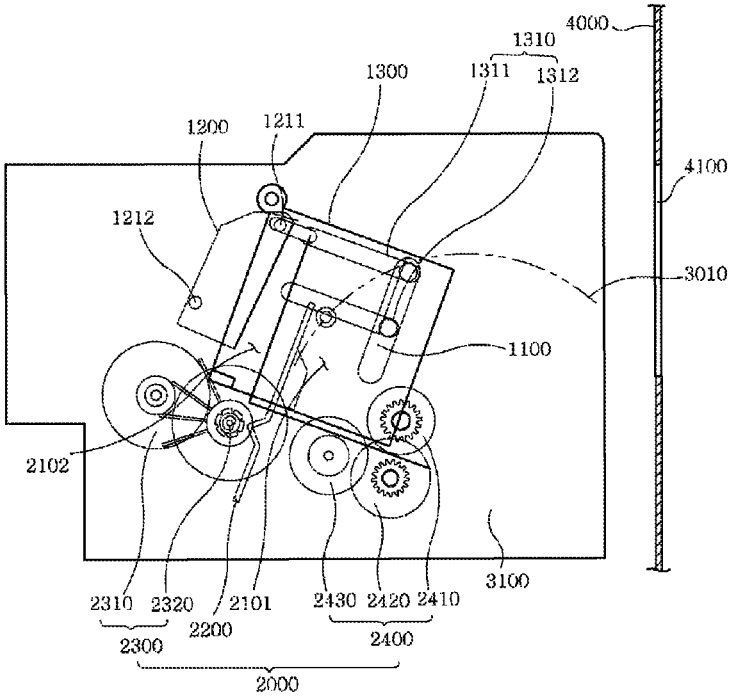
FIG. 6 is a schematic view illustrating the construction of an apparatus for receiving and dispensing bills in accordance with an embodiment of the present invention.
Figure 7:
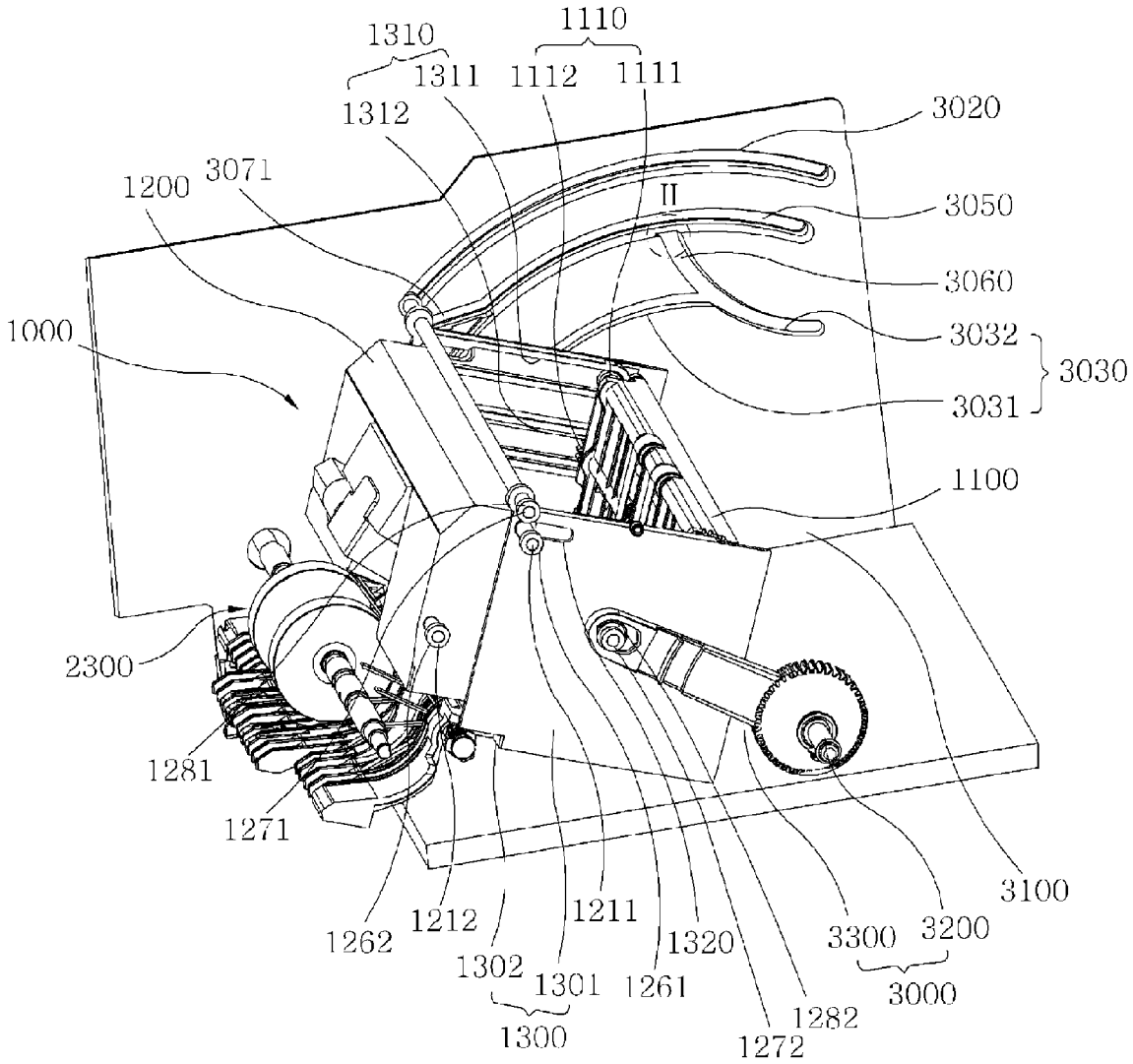
FIG. 7 is a perspective view of the bill receiving and dispensing apparatus in accordance with the embodiment of the present invention.
Figure 8:
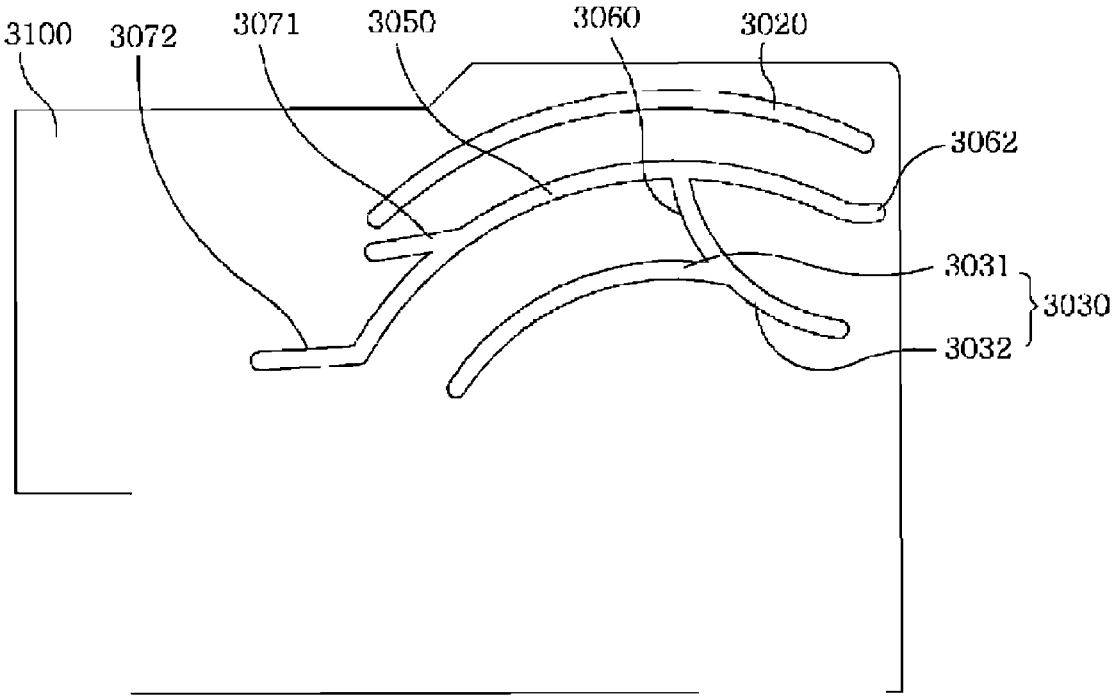
FIG. 8 illustrates a guide plate having a moving rail and a rotating rail in the bill receiving and dispensing apparatus in accordance with the embodiment of the present invention.

FIG. 6 is a schematic view illustrating the construction of an apparatus for receiving and dispensing bills in accordance with an embodiment of the present invention. FIG. 7 is a perspective view of the bill receiving and dispensing apparatus in accordance with the embodiment of the present invention. FIG. 8 illustrates a guide plate having a moving rail and a rotating rail in the bill receiving and dispensing apparatus in accordance with the embodiment of the present invention.

As shown in FIGS. 6 through 8, the bill receiving and dispensing apparatus in accordance with the embodiment of the present invention uses the moving rail assembly so that a pocket 1300 is oriented to be inclined towards a bill receiving and dispensing port 4100 of an ATM, whereby a user can conveniently put bills into or take out from the pocket 1300 that is exposed to the outside through the bill receiving and dispensing port 4100.

Here, the term "bills" refers to money that is made of a substance such as paper and has predetermined contents printed thereon. Furthermore, bills can be deposited or withdrawn in such a way that a single bill or a plurality of bills are received into or dispensed from the ATM. In this embodiment, these will be called bills without distinction of single or plural.

With regard to the drawings illustrating this embodiment, a direction in which bills are inserted into the pocket 1300 of a carriage unit 1000 to deposit the bills through the bill receiving or dispensing port 4100 refers to a bill deposit direction. A direction in which bills are discharged from the pocket 1300 of the carriage unit 1000 to withdraw the bills from the bill receiving or dispensing port 4100 refers to a bill withdrawal direction. A direction perpendicular to the bill deposit direction and the bill withdrawal direction is defined as a perpendicular bill receiving or dispensing direction.

The bill receiving and dispensing apparatus includes the bill receiving and dispensing port 4100, the carriage unit 1000, a separation and piling unit 2000 and a moving path 3010.

In detail, the bill receiving and dispensing port 4100 is provided in a casing 4000 that forms the appearance of the ATM and may be a present type in which it is formed on the front surface of the casing 4000. The bill receiving and dispensing port 4100 makes the bills to be received or dispensed be exposed to the outside so that the user can deposit or withdraw the bills without putting his/her hand into the casing 4000.

The carriage unit 1000 clamps and transfers bills when receiving or dispensing the bills. When the bills are piled or separated, the carriage unit 1000 is interlocked with the separation and piling unit 2000. For this, when bills are received or dispensed, the carriage unit 1000 is disposed at a position corresponding to the bill receiving and dispensing port 4100 which is provided in the front surface of the casing 4000 of the ATM that is exposed to the outside. When bills are piled or separated, the carriage unit 1000 is moved along the moving path 3010 and located at the separation and piling unit 2000.

The carriage unit 1000 includes the pocket 1300, a front plate 1100 and a back plate 1200. The pocket 1300 receives bills and has a housing structure to which the front plate 1100 and the back plate 1200 are movably mounted. The pocket 1300 moves along the moving path 3010 formed between the bill receiving or dispensing port 4100 and the separation and piling unit 2000.

The pocket 1300 includes a pair of sidewalls 1301 and a bottom plate 1302 which connects the sidewalls 1301 to each other. The bottom plate 1302 comprises a support plate to enable the sidewalls 1301 to be parallel to each other. When the carriage unit 1000 is moved to the separation and piling unit 2000 of the casing 4000, the bottom plate 1302 supports bills so that the bills can be moved into the separation and piling unit 2000.

An insert hole (not shown) is formed in the bottom plate 1302. When the carriage unit 1000 is moved to the separation and piling unit 2000 of the ATM, a push plate 2200 which is provided in the separation and piling unit 2000 is inserted into insert hole (not shown) and then moved therein.

A front plate guide rail 1310 for guiding movement of the front plate 1100 and a slot 1320 for guiding movement of the back plate 1200 are formed in each sidewall 1301 of the pocket 1300.

The front plate guide rail 1310 includes a first guide rail 1311 and a second guide rail 1312. The first guide rail 1311 is aligned with the slot 1320 in a line. The first guide rail 1311 and the second guide rail 1312 are disposed parallel to each other.

The main moving shaft 1271 and the sub-moving shaft 1272 are provided in the sidewalls 1301 of the pocket 1300 at positions spaced apart from each other.

The main moving shaft 1271 moves along a rotating rail 3020 which will be explained later herein. The sub-moving shaft 1272 moves along a moving rail 3030. In this embodiment, the sub-moving shaft 1272 provides rotating force to the carriage unit 1000 through a drive means such as a carriage arm 3300 which will be explained later herein, and the main moving shaft 1271 functions to maintain a moving posture of the carriage unit 1000. The present invention is not limited to this structure. For example, the present invention may be configured such that the main moving shaft 1271 provides rotating force to the carriage unit 1000, and the sub-moving shaft 1272 functions to maintain the moving posture of the carriage unit 1000.

Particularly, when the carriage unit 1000 is moved to the bill receiving and dispensing port 4100 to receive bills, the main moving shaft 1271 moves along the rotating rail 3020, and the sub-moving shaft 1272 moves along the moving rail 3030. Thereby, the carriage unit 1000 is rotated upwards at the bill receiving and dispensing port 4100 and is oriented to be inclined at a predetermined angle.

That is, when the main moving shaft 1271 is located at an end of the rotating rail 3020 which is adjacent to the bill receiving and dispensing port 4100, the sub-moving shaft 1272 moves from a first moving rail 3031 to a second moving rail 3032. Thus, the carriage unit 1000 is rotated to be inclined upwards around the main moving shaft 1271.

The front plate 1100 is provided so as to be movable along the front plate guide rail 1310 of the pocket 1300 by means of a front support 1110. In more detail, the front support 1110 includes a first front moving shaft 1111 and a second front moving shaft 1112. The first front moving shaft 1111 is provided so as to be movable along the first guide rail 1311. The second front moving shaft 1112 is provided along so as to be movable along the second guide rail 1312.

The main rotating shaft 1211 and the sub-rotating shaft 1212 are provided in the back plate 1200 at positions spaced apart from each other in the bill receiving or dispensing direction by a predetermined distance. The main rotating shaft 1211 is disposed in the slot 1320 of the pocket 1300 and is able to move, using the main rotating roller 1261, on the main rail 3050 which will be explained later herein. The sub-rotating shaft 1212 can move, using the sub-rotating roller 1262, on the main rail 3050.

Particularly, when the carriage unit 1000 is moved to the bill receiving and dispensing port 4100 and is oriented to be inclined upwards to receiving bills, the main rotating shaft 1211 is interlocked with the movement of the carriage unit 1000 and moved along the main rail 3050 and an extension rail 3062, and the sub-rotating shaft 1212 is moved along the main rail 3050 and the sub-rail 3060.

Furthermore, when the carriage unit 1000 enters the separation and piling unit 2000, the main rotating shaft 1211 is interlocked with the movement of the carriage unit 1000 and moved along the main rail 3050 and the first inclined rail 3071, and the sub-rotating shaft 1212 is moved along the main rail 3050 and the second inclined rail 3072. At this time, the main rotating shaft 1211 moves along the slot 1320 of the pocket 1300 in the bill deposit direction, the sub-rotating shaft 1212 rotates around the main rotating shaft 1211 by a predetermined angle such that the back plate 1200 is oriented to be inclined. Then, space is secured by the movement of the main rotating shaft 1211 along the slot 1320 and the rotation of the sub-rotating shaft 1212. This space becomes a path along which bills to be dispensed are moved and piled in a piling space 2102 by the piling unit 2300.

The separation and piling unit 2000 has a separation space 2101 in which received bills are on standby before being separated sheet-by-sheet, and the piling space 2102 in which bills to be dispensed are piled. The separation space 2101 is disposed ahead of the push plate 2200. The piling space 2102 is disposed behind the push plate 2200.

In detail, the carriage unit 1000 enters the separation and piling unit 2000, the separation space 2101 is formed between the push plate 2200 and the front plate 1100, and the piling space 2102 is formed between the push plate 2200 and the back plate 1200.

The push plate 2200 for guiding movement of bills is installed in the separation and piling unit 2000 s The push plate 2200 is provided so as to be movable in the front-rear direction of the separation and piling unit 2000 (in the left-right direction of FIG. 6). Here, the push plate 2200 can move along a separate guide rail (not shown), which extends in the front-rear direction of the separation and piling unit 2000, and receives drive force from a motor (not shown).

In the separation and piling unit 2000, the piling unit 2300 is provided at an inlet side of the piling space 2102, and a separation unit 2400 is provided at an outlet side of the separation space 2101. The piling unit 2300 strikes the trailing end of bills that are guided along a transfer path (not shown) so as to guide piling of the bills in the piling space 2102. The piling unit 2300 includes a transfer roller 2310 and a sheet roller 2320.

The transfer roller 2310 guides bills, which are transferred along the transfer path (not shown), to the sheet roller 2320. The sheet roller 2320 includes a blade-shaped elastic sheet which strikes the trailing end of the bills that enter the piling space 2102 so that the bills can be piled in the piling space 2102.

The separation unit 2400 of the separation and piling unit 2000 functions to separate the bills, which have been transferred to the separation space 2101, individually from each other sheet-by-sheet and transfers them. The separation unit 2400 includes a pick-up roller 2410, a feed roller 2420 and a guide roller 2430. The pick-up roller 2410 guides the separation of bills. The feed roller 2420 transfers the sheets of bills that have been separated by the pick-up roller 2410 to a transfer path (not shown) for discrimination. The guide roller 2430 overlaps the feed roller 2420 to prevent the bills from being separated as two or more sheets stuck together.

As shown in FIG. 2, the moving path 3010 includes the main rail 3050 and the sub-rail 3060. The main rail 3050 includes the first path a along which the main rotating roller 1261 moves, and the second path b along which the sub-rotating roller 1262 moves. The sub-rail 3060 branches off from the second path b and extends a predetermined length to guide the sub-rotating roller 1262.

By virtue of the above-mentioned structure, the main rotating roller 1261 can continuously move along the main rail 3050, and the sub-rotating roller 1262 that has moved along the main rail 3050 may branch off from the main rail 3050 into the sub-rail 3060, or the sub-rotating roller 1262 that has moved along the sub-rail 3060 may enter the main rail 3050 and move therealong.

Particularly, in this embodiment, the moving path 3010 can provide trajectories for the carriage unit 1000 between the bill receiving and dispensing port 4100 and the separation and piling unit 2000.

The moving path 3010 includes the main rail 3050, the sub-rail 3060, the rotating rail 3020 along which a main moving roller 1281 of the main moving shaft 1271 moves, and the moving rail 3030 along which the sub-moving roller 1282 of the sub-moving shaft 1272 moves. The rotating rail 3020 provides a trajectory for the carriage unit 1000 that moves between the bill receiving and dispensing port 4100 and the separation and piling unit 2000.

The moving rail 3030 includes the first moving rail 3031 which is disposed below the main rail 3050 and oriented parallel to the main rail 3050, and the second moving rail 3032 which is disposed adjacent to the bill receiving and dispensing port 4100 and extended from the first moving rail 3031 and the sub-rail 3060. The second moving rail 3032 is curved in a direction opposite to the direction in which the first moving rail 3031 is curved. Therefore, the second moving rail 3032 can provide a trajectory along which the carriage unit 1000 is rotated upwards at a position adjacent to the bill receiving and dispensing port 4100.

In this embodiment, although the moving path 3010 is illustrated as providing arc-shaped trajectories, the spirit of the present invention is not limited to this structure, and any type of trajectories can be provided, so long as the carriage unit 1000 can effectively move along the trajectories. For example, the moving path 3010 may provide a curved trajectory having a wave shape as well as an arc shape, or a linear trajectory.

The moving path 3010 is formed in each of guide plates 3100 which are disposed on opposite sides of the carriage unit 1000. For example, the moving rail 4100 that has an elongated depression or slot is formed in the guide plate 3100.

The main rail 3050 is connected to the extension rail 3062 and the sub-rail 3060. The extension rail 3062 is curved in a direction opposite to the direction in which the main rail 3050 is curved. The sub-rail 3060 is connected to the main rail 3050 such that the carriage unit 1000 can be oriented to be inclined upwards at a position adjacent to the bill receiving and dispensing port 4100.

By virtue of such a branching movement method of the sub-rotating roller 1262, the sub-rotating roller 1262 can move along the main rail 3050 and branch off into the second inclined rail 3072.

The main rail 3050 includes the first inclined rail 3071 and the second inclined rail 3072. The first inclined rail 3071 branches off from the main rail 3050 and provides the trajectory for the back plate 1200 to increase the distance between the back plate 1200 and the front plate 1100. The second inclined rail 3072 is bent from an end of the main rail 3050 and provides a trajectory along which the back plate 1200 rotates so that the back plate 1200 is oriented to be inclined by a predetermined angle relative to the front plate 1100.

The carriage unit 1000 is connected to a carriage transfer unit 3000 such that the carriage unit 1000 can move along the moving path 3010 between the bill receiving and dispensing port 4100 and the separation and piling unit 2000.

The carriage transfer unit 3000 includes a drive motor shaft 3200 and the carriage arm 3300.

The drive motor shaft 3200 provides rotating force to the carriage unit 1000. The drive motor shaft 3200 connects the carriage arm 3300 to a drive source such as a drive motor (not shown).

The carriage arm 3300 receives rotating force from the drive motor shaft 3200 and rotates the carriage unit 1000. A first end of the carriage arm 3300 is rotatably connected to the sub-moving shaft 1272, and a second end thereof is connected to the drive motor shaft 3200.

Therefore, when the carriage arm 3300 is rotated in a clockwise direction (with reference to the drawings) by the drive motor shaft 3200, the sub-moving shaft 1272 moves along the first moving rail 3031 and the second moving rail 3032 in a clockwise direction. In addition, the main moving shaft 1271 moves along the rotating rail 3020 in the clockwise direction, and the main rotating shaft 1211 moves along the first inclined rail 3071, the main rail 3050 and the extension rail 3062. The sub-rotating shaft 1212 moves along the second inclined rail 3072, the main rail 3050 and the sub-rail 3060.

Particularly, when the main moving shaft 1271 is located at the end of the rotating rail 3020 that is adjacent to the bill receiving and dispensing port, because the sub-moving shaft 1272 moves along the second moving rail 3032, the carriage unit 1000 is rotated around the main moving shaft 1271 and oriented to be inclined upwards. At this time, the main rotating shaft 1211 moves along the extension rail 3062, and the sub-rotating shaft 1212 moves along the sub-rail 3060.

On the other hand, when the carriage arm 3300 is rotated in the counterclockwise direction by the drive motor shaft 3200, the sub-moving shaft 1272 is moved in the counterclockwise direction along the second moving rail 3032 and the first moving rail 3031. Further, the main moving shaft 1271 is moved in the counterclockwise direction along the rotating rail 3020, and the main rotating shaft 1211 is moved along the extension rail 3062, the main rail 3050 and the first inclined rail 3071. In addition, the sub-rotating shaft 1212 is moved along the sub-rail 3060, the main rail 3050 and the second inclined rail 3072.

Particularly, the main rotating shaft 1211 moves along the slot 1320 of the pocket 1300 in the bill deposit direction while moving along the first inclined rail 3071. The sub-rotating shaft 1212 rotates by a predetermined angle around the main rotating shaft 1211 while moving along the second inclined rail 3072, thus causing the back plate 1200 to be inclined.

In this embodiment, although the carriage unit 1000 is illustrated as being rotated by the carriage arm 3300, the spirit of the present invention is not limited to this. The carriage unit 1000 is moved by a separate drive means. For instance, the present invent may be configured in such a way that a separate drive device (e.g., a pinion gear and a motor) which moves along the moving path 3010 is mounted to the carriage unit 1000, and an interlocking unit (e.g., a rack gear) which is interlocked with the drive device is provided on the guide plate 3100.

Hereinafter, the operation of the bill receiving and dispensing apparatus in accordance with the embodiment of the present invention having the above-mentioned construction will be explained.

In the following description, for the sake of description, the right side of each drawing is designated as the front, the left side is the rear, the upper side is the upper, and the lower side is the lower. Depending on the position or conditions of each element in each drawing, the definition of the direction of the element may be changed.

Figure 9:
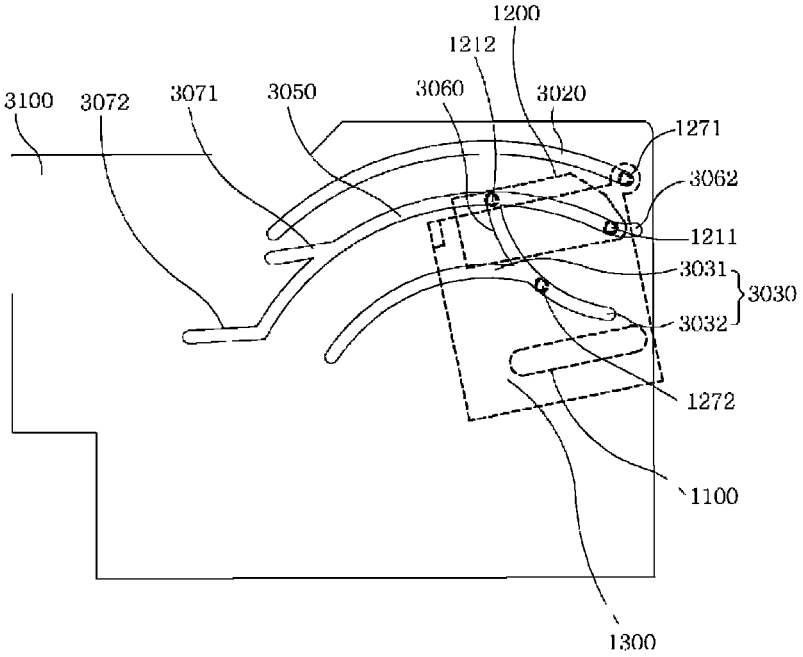
FIG. 9 is a view illustrating conditions of a moving shaft and a rotating shaft of the bill receiving and dispensing apparatus when a carriage unit is rotated by a predetermined angle towards a bill receiving and dispensing port, in accordance with the embodiment of the present invention.
Figure 10:
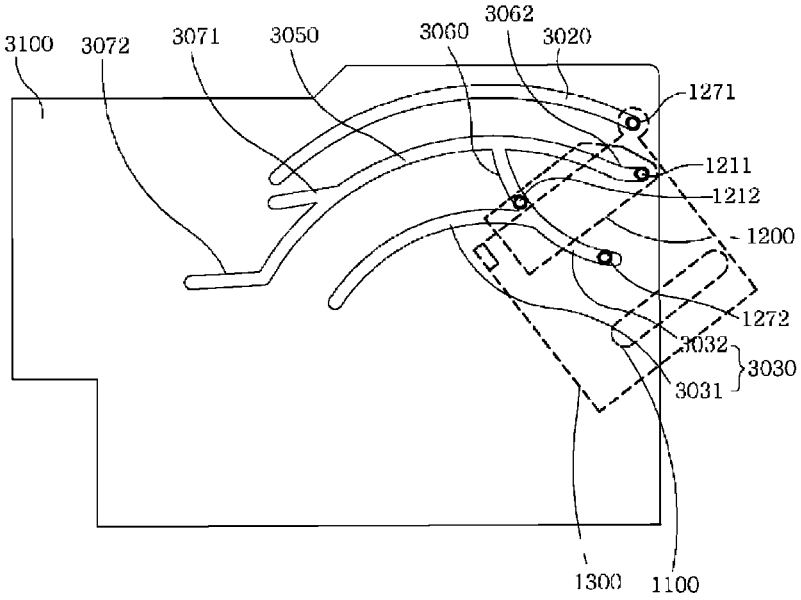
FIG. 10 is a view illustrating conditions of the moving shaft and the rotating shaft of the bill receiving and dispensing apparatus when in a bill receiving standby state, in accordance with the embodiment of the present invention.
Figure 11:
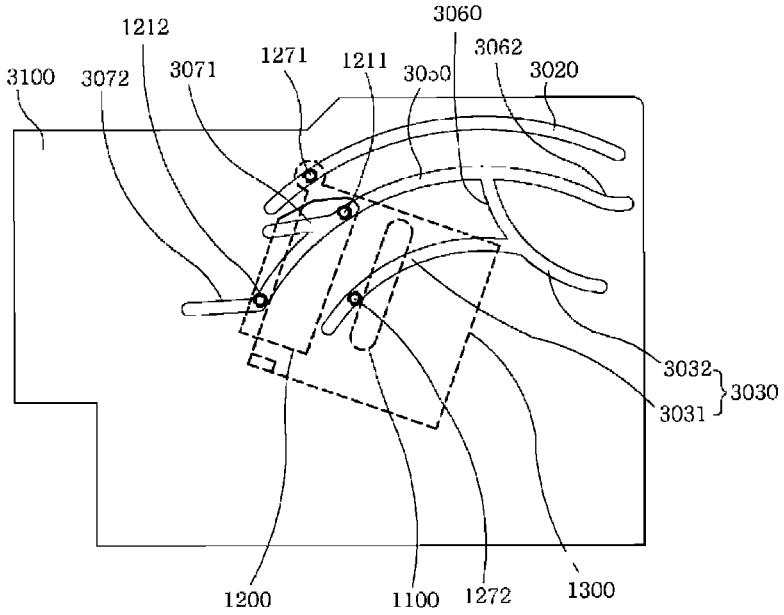
FIG. 11 is a view illustrating conditions of the moving shaft and the rotating shaft of the bill receiving and dispensing apparatus when the carriage unit is rotated by a predetermined angle towards a separation and piling unit, in accordance with the embodiment of the present invention.
Figure 12:
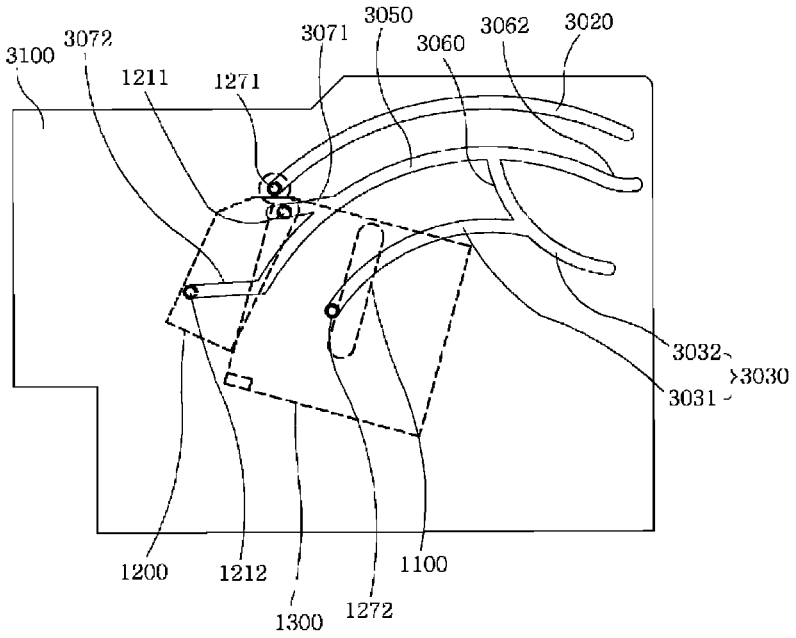
FIG. 12 is a view illustrating conditions of the moving shaft and the rotating shaft of the bill receiving and dispensing apparatus when the carriage unit enters the separation and piling unit, in accordance with the embodiment of the present invention.

FIG. 9 is a view illustrating conditions of the moving shaft and the rotating shaft of the bill receiving and dispensing apparatus when the carriage unit is rotated by a predetermined angle towards the bill receiving and dispensing port, in accordance with the embodiment of the present invention. FIG. 10 is a view illustrating conditions of the moving shaft and the rotating shaft of the bill receiving and dispensing apparatus when in a bill receiving standby state, in accordance with the embodiment of the present invention. FIG. 11 is a view illustrating conditions of the moving shaft and the rotating shaft of the bill receiving and dispensing apparatus when the carriage unit is rotated by a predetermined angle towards the separation and piling unit, in accordance with the embodiment of the present invention. FIG. 12 is a view illustrating conditions of the moving shaft and the rotating shaft of the bill receiving and dispensing apparatus when the carriage unit enters the separation and piling unit, in accordance with the embodiment of the present invention.

FIG. 9 illustrates conditions of the carriage unit 1000 rotated by a predetermined angle towards the bill receiving and dispensing port.

The main moving shaft 1271 is moved along the rotating rail 3020 towards the bill receiving and dispensing port (in the right direction of FIG. 9) and then located at the end of the rotating rail 3020 that is adjacent to the bill receiving and dispensing port. The sub-moving shaft 1272 moves along the first moving rail 3031 towards the bill receiving and dispensing port. The main rotating shaft 1211 and the sub-rotating shaft 1212 move along the main rail 305 towards the bill receiving and dispensing port.

At this time, the front plate 1100 of the carriage unit 1000 is moved to a lower end of the front plate guide rail 1310 so that space for receiving bills can be secured between the back plate 1200 and the front plate 1100.

FIG. 10 illustrates a bill receiving standby state of the carriage unit 1000.

While the main moving shaft 1271 is located at the end of the rotating rail 3020 that is adjacent to the bill receiving and dispensing port, the main rotating shaft 1211 is located at the end of the extension rail 3062, and the sub-moving shaft 1272 moves along the second moving rail 3032 towards the bill receiving and dispensing port. Thus, the carriage unit 1000 is rotated around the main moving shaft 1271 and oriented to be inclined upwards.

FIG. 11 illustrates the carriage unit 1000 rotated by a predetermined angle towards the separation and piling unit 2000.

The sub-moving shaft 1272 moves along the second moving rail 3032 and the first moving rail 3031 towards the separation and piling unit 2000 (in the left direction of FIG. 11). The main moving shaft 1271 moves along the rotating rail 3020 towards the separation and piling unit 2000. The main rotating shaft 1211 moves along the extension rail 3062 and the main rail 3050 towards the separation and piling unit 2000. The sub-rotating shaft 1212 moves along the sub-rail 3060 and the main rail 3050 towards the separation and piling unit 2000.

Here, the bills that are compressed between the back plate 1200 and the front plate 1100 are moved to the rear portion of the carriage unit 1000 by rotation of a conveying belt (not show).

FIG. 12 illustrates the carriage unit 1000 that enters the separation and piling unit 2000.

The main rotating shaft 1211 moves along the first inclined rail 3071 towards the separation and piling unit 2000 (in the left direction of FIG. 12) and, simultaneously, moves along the slot 1320. The sub-rotating shaft 1212 moves along the second inclined rail 3072 and, simultaneously, rotates by a predetermined angle around the main rotating shaft 1211, thus causing the back plate 1200 to be inclined.

As described above, although the present invention has been described in detail with reference to the embodiments and the accompanying drawings, the above-described embodiments are only illustrative of preferable examples of the present invention. Thus, the present invention is not limited to the embodiments, but the scope of the present invention should be construed by the claims and their equivalent concepts.

What is claimed is:

1. An apparatus for receiving and dispensing bills, comprising:

a bill receiving and dispensing port receiving or dispensing bills;

a separation and piling unit having a separation space in which the bills are separated from each other sheet-by-sheet, and a piling space in which the bills to be dispensed are piled;

a carriage unit clamping the bills received into the bill receiving and dispensing port and transferring the bills to the separation and piling unit, or clamping the bills to be dispensed and transferring the bills to the bill receiving and dispensing port, the carriage unit comprising a main rotating roller, and a sub-rotating roller disposed at a different widthwise position from the main rotating roller's widthwise position; and a moving path providing a trajectory for the carriage unit between the bill receiving and dispensing port and the separation and piling unit such that the carriage unit is oriented to be inclined upwards at a position adjacent to the bill receiving and dispensing port.

2. The apparatus of claim 1, wherein the moving path comprises:

a main rail comprising a first path for guiding the main rotating roller, and a second path for guiding the sub-rotating roller; and a sub-rail branching off from the second path and extending in a different direction from the main rail to guide the sub-rotating roller.

3. The apparatus of claim 2, wherein the moving path further comprises:

a rotating rail disposed above the main rail and oriented parallel to the main rail; and a moving rail comprising a first moving rail disposed below the main rail, the first moving rail being parallel to the main rail, and a second moving rail connected to the first moving rail and the sub-rail at a position adjacent to the bill receiving and dispensing port, the second moving rail being curved in a direction opposite to a direction in which the main rail is curved.

4. The apparatus of claim 3, wherein the carriage unit comprises:

a main moving shaft provided with a main moving roller being movable along the rotating rail; and a sub-moving shaft provided with a sub-moving roller being movable along the moving rail.

5. The apparatus of claim 2, wherein the carriage unit comprises:

a pocket receiving the bills;

a front plate forming one sidewall of the pocket and supporting the bills; and a back plate disposed facing the front plate so that the back plate along with the front plate clamps the bills, with a main rotating shaft provided on a first end of the back plate, the main rotating shaft having the main rotating roller, and a sub-rotating shaft provided on a second end of the back plate, the sub-rotating shaft having the sub-rotating roller.

6. The apparatus of claim 5, wherein the carriage unit is rotated around the main moving shaft and oriented to be inclined upwards, when the sub-moving shaft moves along the second moving rail towards the bill receiving and dispensing port while the main moving shaft is located at an end of the rotating rail that is adjacent to the bill receiving and dispensing port.

7. The apparatus of claim 5, wherein a front plate guide rail and a slot are formed in the pocket on a same extension line, the front plate guide rail for guiding the front plate moving in a direction perpendicular to a direction in which the bills are received or dispensed, the slot for guiding the main rotating shaft moving in a direction perpendicular to the direction in which the bills are received or dispensed.

8. The apparatus of claim 1, wherein the separation and piling unit comprises:

a push plate separating the separation space from the piling space;

a piling unit installed at an inlet side of the piling space, the piling unit for piling bills drawn into the piling space; and a separation unit installed at an outlet side of the separation space, the separation unit for separating bills drawn into the separation space from each other sheet-by-sheet.

9. The apparatus of claim 1, further comprising a carriage transfer unit for moving the carriage unit along the moving rail.

10. The apparatus of claim 1, wherein the carriage transfer unit comprises:

a drive motor shaft for providing drive force to move the carriage unit along the moving path; and a carriage arm connected at a first end thereof to the carriage unit by a sub-moving shaft, the carriage arm being connected at a second end thereof to the drive motor shaft.

* * * * *